United States Patent [19]

Posner et al.

[11] 4,193,225

[45] Mar. 18, 1980

[54] AUXILIARY WINDOW ELEMENT

[75] Inventors: Louis L. Posner, Huntingdon Valley; Patrick J. McGarry, Wyndmoor, both of Pa.

[73] Assignee: Thermal Economics, Inc., Pa.

[21] Appl. No.: 931,879

[22] Filed: Aug. 8, 1978

Related U.S. Application Data

[63] Continuation-in-part of Ser. No. 825,989, Aug. 19, 1977.

[51] Int. Cl.[2] ..... E05C 21/02

[52] U.S. Cl. ..... 49/465; 49/421; 160/376

[58] Field of Search ..... 49/65, 421; 160/376

[56] References Cited

U.S. PATENT DOCUMENTS

| | | | |
|---|---|---|---|
| 794,469 | 7/1905 | Sherwood | 160/376 X |
| 2,597,484 | 5/1952 | Heilig | 160/376 X |

*Primary Examiner*—Kenneth Downey
*Attorney, Agent, or Firm*—Paul & Paul

[57] ABSTRACT

An adjustable auxiliary window element is provided for easy installation in and removal from a window frame, and particularly for use as a storm window device. The auxiliary window element includes a window pane which is perimetrically encased in side, top and bottom channel members, and four corner members, and a pair of cover channel members, each adjustable disposed so as to cover two corner members and a side channel and adapted to snugly fit in a window frame. The corner members have resilient members secured thereto which bias said cover channel members outwardly.

1 Claim, 6 Drawing Figures

28
24
26
25
23
27

19
21
27
25
26
13
17
27
11
10
14
1
12
16
15
22
20

AUXILIARY WINDOW ELEMENT

This application is a continuation-in-part of our copending application Ser. No. 825,989 filed Aug. 19, 1977.

BACKGROUND OF THE INVENTION

1. Field of the Invention

The invention relates generally to a window element which is adapted to be fitted into window frames of varying sizes. It is particularly useful for functioning as a storm window and may be used in conjunction with the existing windows of a structure.

2. Description of the Prior Art

In these days of energy shortages and increasing cost of fuel for heating and air conditioning homes and other structures, it is important to conserve energy and reduce heating and air conditioning bills. One of the greatest areas for potential heat and air conditioning loss which lies in and around the windows of such structures, can be mitigated by installation of storm windows.

While the prior art has recognized such a need, it does not provide such an auxiliary window which may be easily installed, and which may be readily and inexpensively manufactured. The present invention is an improvement over the following patents:

U.S. Pat. No. 735,976, W. C. Hiering
U.S. Pat. No. 1,287,409, G. I. Paige
U.S. Pat. No. 1,435,270, J. O. Wagner
U.S. Pat. No. 2,205,123, C. L. Metzgar, et al.
U.S. Pat. No. 2,207,198, P. Herman
U.S. Pat. No. 2,612,947, A. S. Jenks
U.S. Pat. No. 2,637,879, E. C. Mueller
U.S. Pat. No. 2,776,736, S. R. Aaron
U.S. Pat. No. 2,814,078, A. W. Durr
U.S. Pat. No. 2,834,071, E. Camerino These patents contain a multitude of undesirable moving parts, including nuts and bolts, require deformation of the window frame by requiring various flanges and other interlocking mechanisms necessary for retaining the auxiliary window to the frame, disclose telescopic joints requiring complicated mechanisms to maneuver various corner brackets to urge the frame outwardly, etc.

Accordingly, it is an object of the present invention to remedy the aforementioned disadvantages.

Another object of the present invention is to provide an auxiliary window element which is of simplistic design and can be readily and economically manufactured.

Yet another object of the present invention is to provide an auxiliary window element which functions as a storm window and may be readily installed and removed from varying sized window frames.

Still yet a further object of the present invention is to provide an auxiliary window element which may be used in conjunction with double-hung window sashes.

Other objects and advantages of the present invention will be readily apparent to those skilled in the art from a reading of the following brief descriptions of the drawing figures, the detailed description of the preferred embodiment and the appended claims.

BRIEF DESCRIPTION OF THE DRAWING FIGURES

PREFERRED EMBODIMENT

Figure 4:
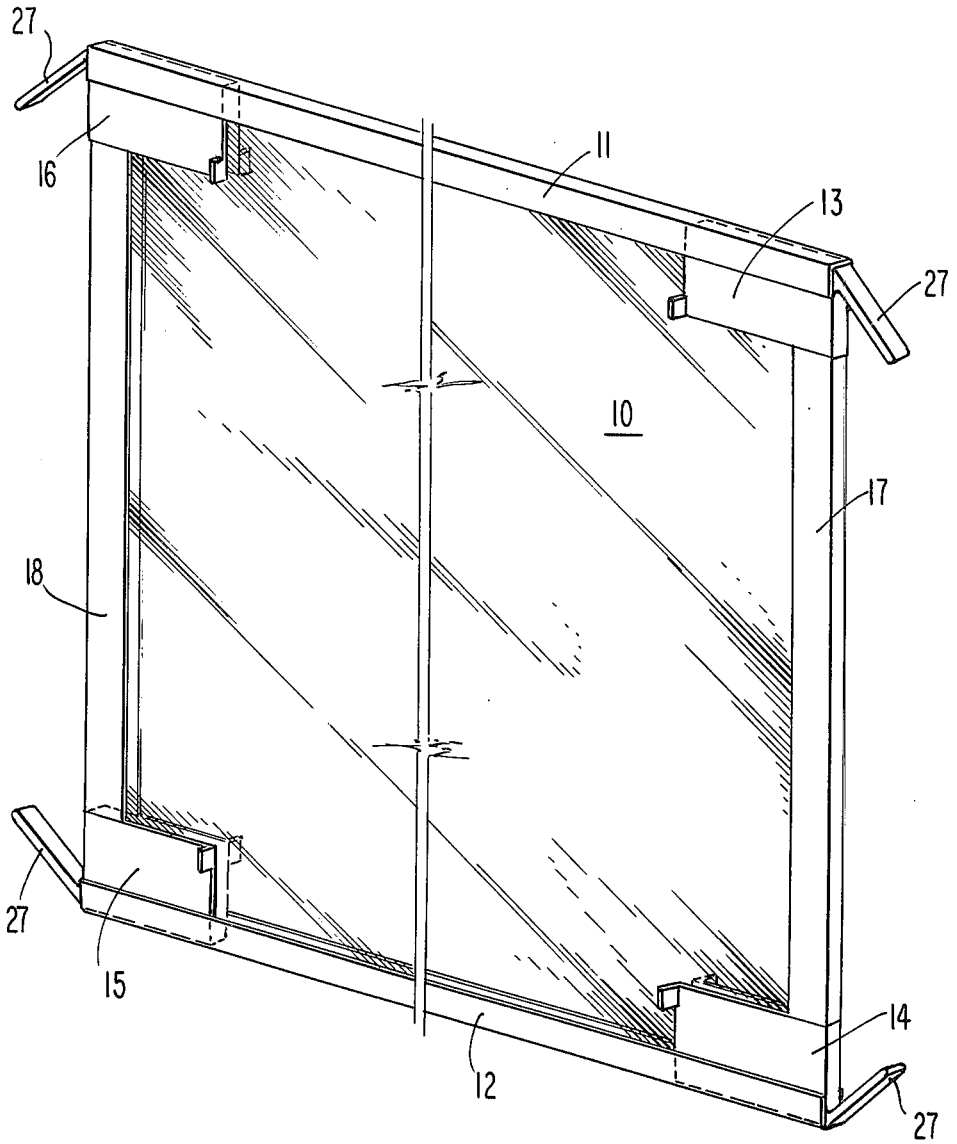
FIG. 4 is a broken perspective view of a sub-combination of the window element of the present invention.
Figures 5, 6:
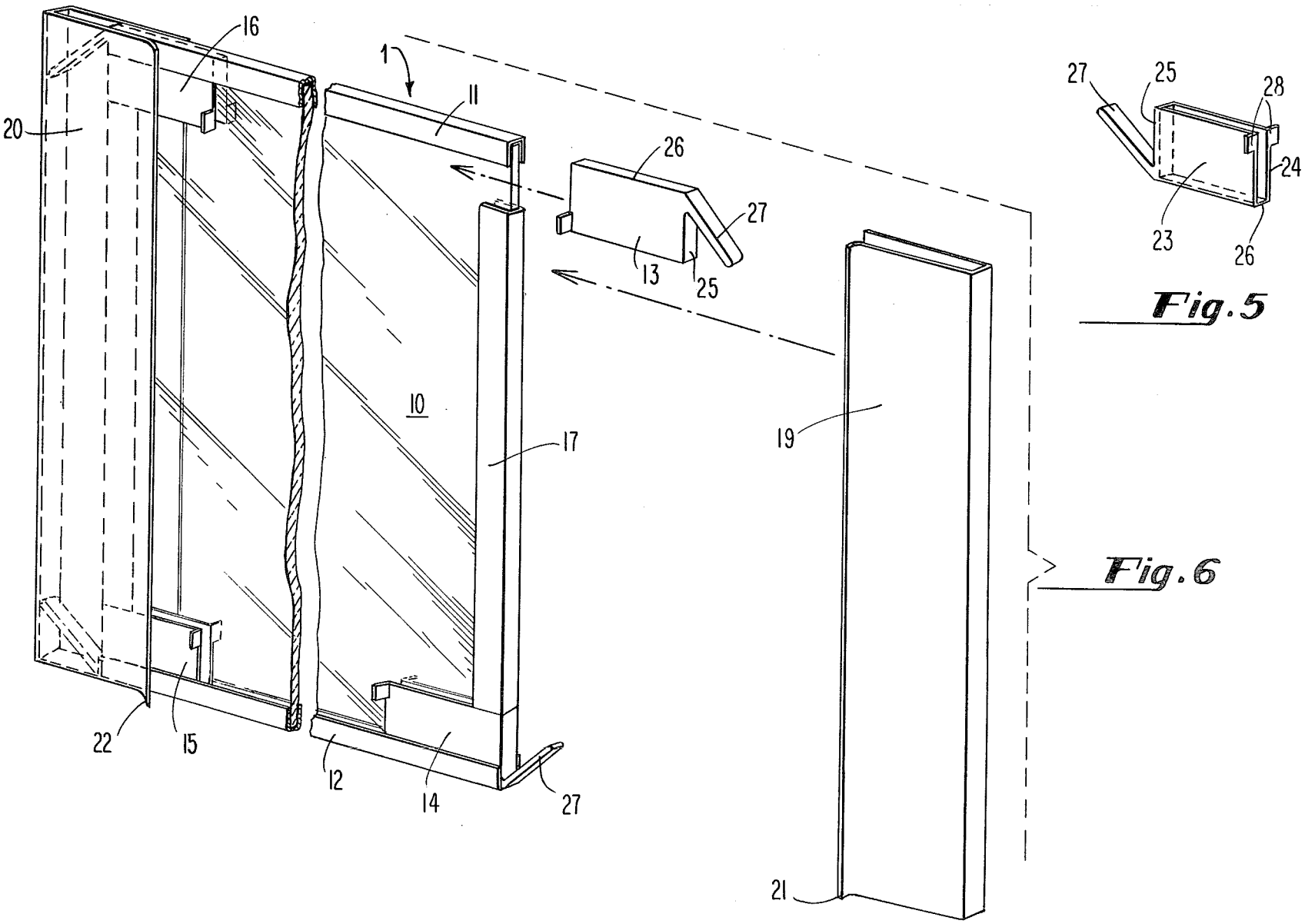
FIG. 5 is a perspective view of another subcombination of the window element of the present invention.
FIG. 6 is an exploded broken perspective view of the window element of the present invention.

Referring now to FIG. 6, auxiliary window element 1 is depicted having window 10 which is of glass or other suitable material encased by the combination of top and bottom channels 11, 12, corner blocks 13, 14, 15, 16 and side channels 17, 18 (FIG. 4). It is to be understood that window 10 can be manufactured out of a single pane or a double pane, otherwise known as thermopane.

A pair of U-shaped adjustable cover channels 19, 20 are adapted to slidable engage the sides of window element 1, and may be seen in scale to provide considerable width extension of the window element. Cover channels 19, 20 are in the preferred embodiment constructed of aluminum. They may likewise be constructed of extruded plastic such as polyvinyl chloride, may be a composite of fiberglass or a combination of polyester and fiberglass, or be made of a structural foam material, or be made of highly insulative material. One leg 21, 22 of each channel 19,20 is curved arcuately outwardly at the free end thereof so as to form a finger grip.

Figure 2:
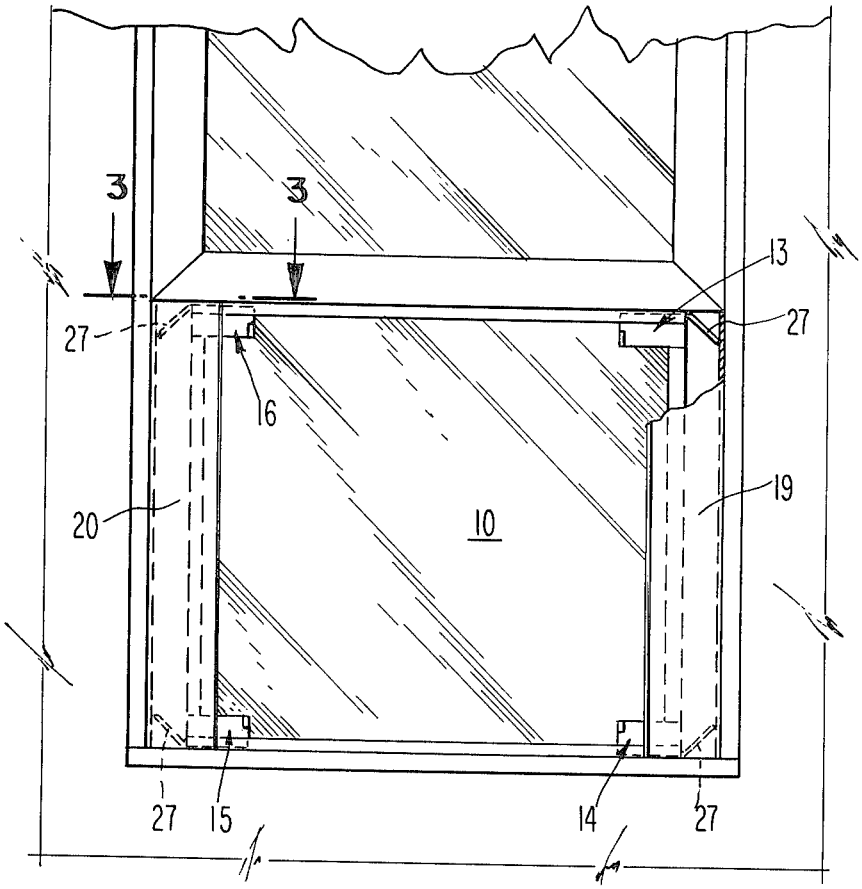
FIG. 2 is a detailed view in partial section, taken along the lines 2—2 of FIG. 1.
Figure 3:
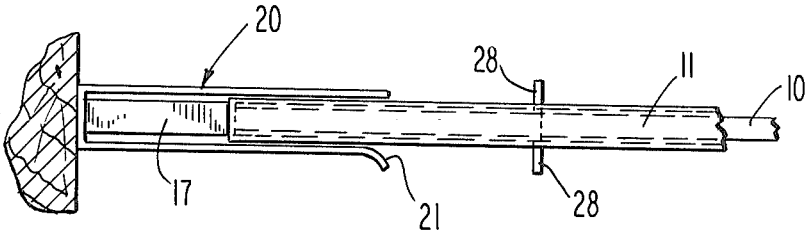
FIG. 3 is a enlarged sectional view taken along the lines 3—3 of FIG. 2.

The construction of corner blocks 13, 14, 15, 16 is shown in FIG. 5 and comprises preferably a one-piece resilient plastic shape having side walls 23, 24 and connecting walls 25, 26. From the intersection of connecting walls 25, 26 there extends a spring element 27. From the free corners of walls 23, 24 extends a tab 28. From FIG. 6 it is clear that upon construction of the window element of this invention the corner blocks 13, 14, 15, 16 protect the corners of window pane 10 and interfit with top and bottom channels 11, 12. Moreover, cover channels 19, 20 suitably engage the sides of the window element and because of their U-shape abut the corresponding spring elements 27. In this manner there is provided a spring loaded adjustment for cover channels 19, 20. Upon inward pressure on channels 19, 20 the spring elements 27 resist deformation and permit ready lateral adjustment to a window frame as shown in FIG. 2.

Vertical adjustment of the window element of this invention is provided by either of channels 11, 12 and the corresponding corner blocks 13, 16 or 14, 15. Accordingly, one may grasp the tabs 28 of the corner blocks engaged by either of the channels 11, 12, whereby a vertical adjustment of the channel with respect to the window pane 10 may be made. In view of standardization in the building trade, the amount of vertical adjustment to be provided is not as much as that of lateral adjustment.

Figure 1:
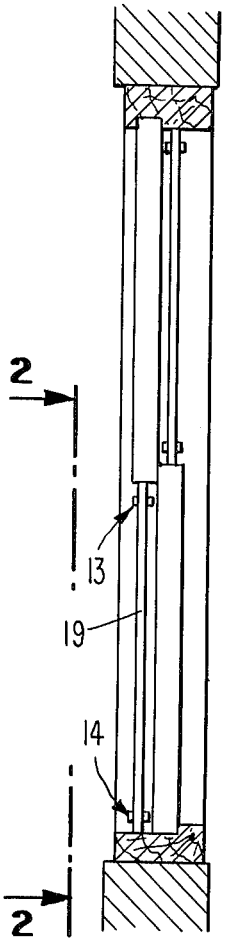
FIG. 1 is a side view taken in section, of the window element of the present invention functioning as storm windows in a window frame housing double hung windows.

The window element of the invention as thus far described can be utilized in a double hung window as is shown in FIG. 1. In this embodiment two such auxiliary window elements 1 are fitted in window frame to provide storm windows for front sash and rear sash.

In installing auxiliary window element 1, cover channels 19, 20 are compressed inwardly to their minimum sized opening and auxiliary window element 1 is placed into position in a window frame under or over a respective sash. Thereafter, cover channels 19, 20 are allowed to expand outwardly and to abut against the side of the frame to form a seal. In removing auxiliary window element 1, channel covers 19, 20 are compressed inwardly by, for example, gripping flanges 21, 22 and channel covers 19, 20 inwardly and out of contact with the sides of the frame.

It is contemplated that auxiliary window element 1 can be made of various heights to fit standardized window frames or may be made of standard heights to fit in conjunction with a window sash into various sized window frames. The auxiliary window element 1 may be fabricated to fit a minimum opening of a standard window frame and thereafter be adapted to fit larger openings by utilizing channel covers 19, 20 together. Thus, an economical auxiliary window element which is adaptable to fit varied window frame widths is provided.

What is claimed is:

1. In an adjustable auxiliary window element adapted to fit in a window frame, said element having a window encased in a perimetric frame having side portions, a top portion, a bottom portion and four corner portions, the improvement which comprises:

adjustable extension means in the form of channels which telescopically engage said encased window laterally;

resilient means secured to said corner portions and extending within said channels and adapted to bias said channels outwardly, wherein said corner portions interfit with said top and bottom portions so as to enable vertical adjustment of said top or bottom portion by adjustment of a corner portion, and wherein said corner portions include a tab positioned thereon without said top and bottom portions and said channels and adapted to be gripped for ease of adjustment, and wherein said channels are formed with a free end extending away from said window for ease of adjustment.

* * * * *